US010677117B2

(12) United States Patent
Taguchi

(10) Patent No.: US 10,677,117 B2
(45) Date of Patent: Jun. 9, 2020

(54) OIL SUPPLY DEVICE FOR INTERNAL COMBUSTION ENGINE

(71) Applicant: NISSAN MOTOR CO., LTD., Yokohama-shi, Kanagawa (JP)

(72) Inventor: Arata Taguchi, Yokohama (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 475 days.

(21) Appl. No.: 14/437,879

(22) PCT Filed: Oct. 31, 2013

(86) PCT No.: PCT/JP2013/079517
§ 371 (c)(1),
(2) Date: Apr. 23, 2015

(87) PCT Pub. No.: WO2014/073444
PCT Pub. Date: May 15, 2014

(65) Prior Publication Data

US 2015/0300218 A1 Oct. 22, 2015

(30) Foreign Application Priority Data

Nov. 7, 2012 (JP) ..... 2012-244991

(51) Int. Cl.
*F01M 1/16* (2006.01)
*F01M 1/08* (2006.01)
*F01M 1/02* (2006.01)

(52) U.S. Cl.
CPC ..... *F01M 1/16* (2013.01); *F01M 1/02* (2013.01); *F01M 1/08* (2013.01); *F01M 2001/0238* (2013.01); *F01M 2001/0246* (2013.01)

(58) Field of Classification Search
CPC .. F01M 1/02; F01M 1/08; F01M 1/16; F01M 2001/0238; F01M 2001/0246; F01M 5/00
(Continued)

(56) References Cited

U.S. PATENT DOCUMENTS 4,503,679 A 3/1985 Saito et al.
2001/0031204 A1* 10/2001 Oba ..... F04C 14/226 417/220
(Continued)

FOREIGN PATENT DOCUMENTS

JP 56113108 U * 9/1981
JP S56-113108 U 9/1981
(Continued)

OTHER PUBLICATIONS

Machine Translation of JP JP56113108 U PDF File Name: "JP56113108U_Machine_Translation.pdf".*
(Continued)

*Primary Examiner* — Stephen K Cronin
*Assistant Examiner* — Ruben Picon-Feliciano
(74) *Attorney, Agent, or Firm* — Faegre Drinker Biddle & Reath LLP

(57) ABSTRACT

An oil supply device for an internal combustion engine includes: a variable displacement pump (1) that varies a discharge pressure at which oil is discharged; an oil passage (2) through which the oil discharged from the pump (1) flows; an oil filter (3) and an oil cooler (4) each of which is arranged in the oil passage (2); a bypass passage (5) connected to the oil passage (2) and bypassing the oil cooler (4); and a bypass valve (6) that opens and closes the bypass passage (5) according to a pressure of the oil. The bypass valve (6) is operated to control the flow of the oil through the
(Continued)

oil cooler 4 as the discharge pressure of the pump (1) is adjusted according to operating conditions of the internal combustion engine.

6 Claims, 7 Drawing Sheets

(58) Field of Classification Search
USPC ..... 123/196 CP
See application file for complete search history.

(56) References Cited

U.S. PATENT DOCUMENTS

| | | | | |
|---|---|---|---|---|
| 2004/0112171 | A1* | 6/2004 | Kuhstrebe | B60K 6/547 74/730.1 |
| 2012/0048228 | A1 | 3/2012 | Chung | |
| 2012/0118257 | A1* | 5/2012 | Chung | F01M 1/02 123/196 R |
| 2012/0132172 | A1* | 5/2012 | Kobayashi | F01M 1/08 123/196 R |

FOREIGN PATENT DOCUMENTS

| | | | | |
|---|---|---|---|---|
| JP | 58131304 | A | * | 8/1983 |
| JP | S58-131304 | A | | 8/1983 |
| JP | 08246871 | A | * | 9/1996 |
| JP | H08-246871 | A | | 9/1996 |
| JP | 2000-328916 | A | | 11/2000 |
| JP | 2000328916 | A | * | 11/2000 |
| JP | 2010-071194 | A | | 4/2010 |
| WO | WO 2007/042067 | A1 | | 4/2007 |
| WO | WO-2012120213 | A1 | | 9/2012 |

OTHER PUBLICATIONS

Machine Translation of JP 2000328916 A PDF File Name: "JP2000328916A_Machine_Translation.pdf".*
Machine Translation of JP 08246871 A PDF File Name: "JP08246871A_Machine_Translation.pdf".*
Machine Translation of JP 58131304 A PDF File Name: "JP58131304A_Machine_Translation.pdf".*
European Office Action dated Apr. 18, 2018 that issued in EP patent application No. 13 853 944.0-1007.

* cited by examiner (a)

(b)

OIL SUPPLY DEVICE FOR INTERNAL COMBUSTION ENGINE

FIELD OF THE INVENTION

The present invention relates to an oil supply device for an internal combustion engine.

BACKGROUND ART

Patent Document 1 discloses an oil supply device for an internal combustion engine, which includes a pump mechanism, an oil passage part that allows oil discharged from the pump mechanism to flow therethrough, an oil recirculation part that branches from the oil passage part and recirculates the oil to a suction side of the pump mechanism, an oil switch valve arranged in the oil recirculation part and an oil injection nozzle that injects the oil supplied from the oil passage part to cool a piston of the internal combustion engine.

In particular, Patent Document 1 teaches a technique to reduce a load of the pump mechanism and promote evaporation of fuel in a combustion chamber during cold operation of the internal combustion engine by opening the oil switch valve, recirculating a part of the oil discharged from the pump mechanism and thereby decreasing the pressure inside the oil passage part while stopping the injection of the oil from the oil injection nozzle.

It is conceivable to arrange an oil cooler on a discharge side of the pump mechanism for cooling of the oil. In such a case, however, the oil flows through the oil cooler all the time even during the pressure decrease control of the oil passage part.

This results in a problem that, in the operation range where there is no need to cool the oil, the load of the pump mechanism increases due to pressure loss caused by the flow of the oil through the oil cooler.

PRIOR ART DOCUMENTS

Patent Document

Patent Document 1: Japanese Laid-Open Patent Publication No. 2010-71194

SUMMARY OF THE INVENTION

In view of the foregoing, the present invention provides an oil supply device for an internal combustion engine in which oil is discharged from a variable displacement pump to an oil passage, characterized by comprising: a controller that adjusts a discharge pressure of the variable displacement pump according to operating conditions of the internal combustion engine; and a bypass valve arranged in the oil passage and opened or closed to restrict the oil from flowing to an oil cooler when a pressure of the oil in the oil passage is lower than a predetermined pressure level.

In the present invention, the flow of the oil into the oil cooler can be controlled by adjusting the discharge pressure of the variable displacement pump according to the engine operating conditions. It is therefore possible to relatively reduce a load of the variable displacement pump.

DESCRIPTION OF EMBODIMENTS

Hereinafter, one exemplary embodiment of the present invention will be described below in detail with reference to the drawings.

Figure 1:
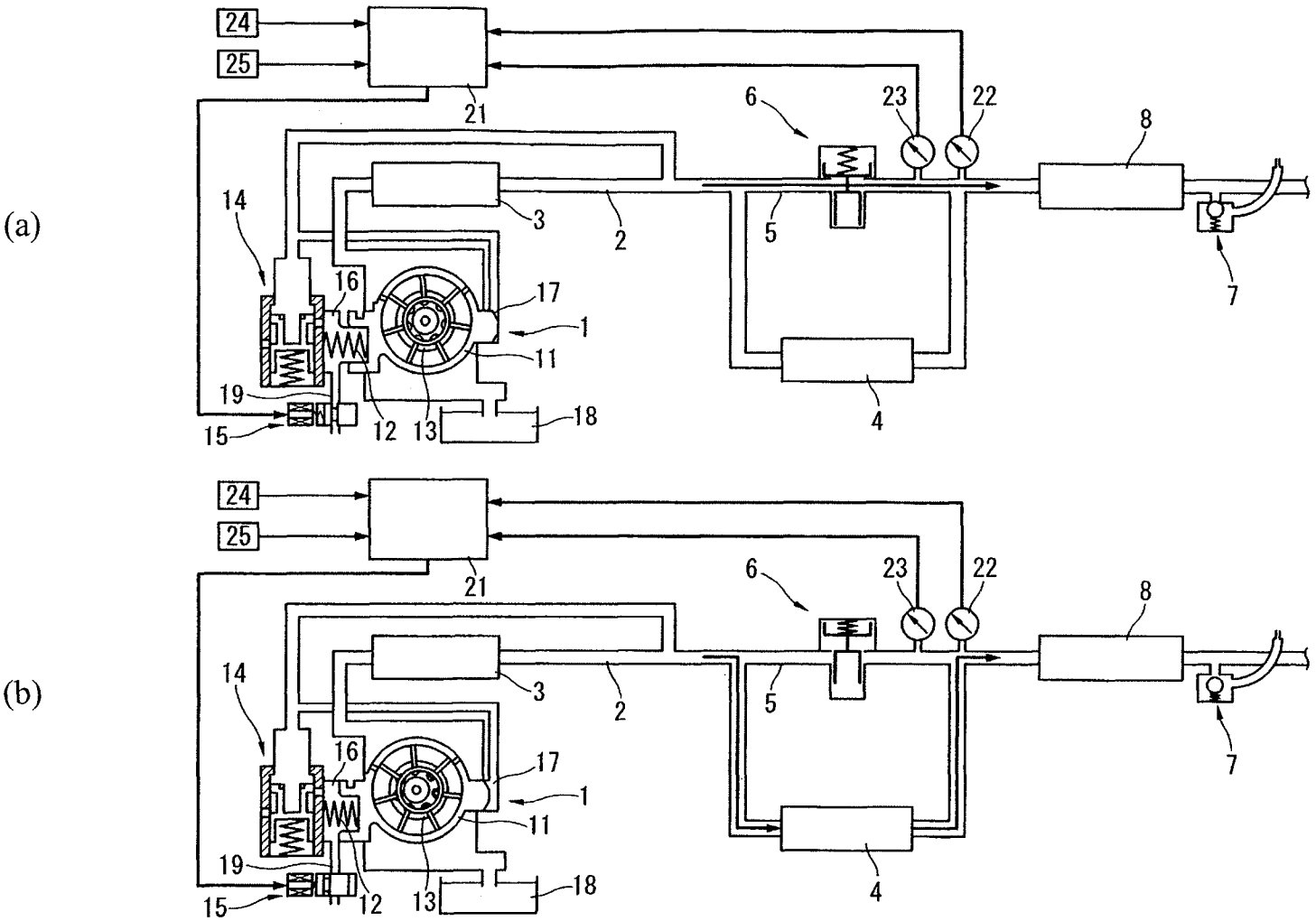
FIGS. 1(*a*) and 1(*b*) are schematic views of a hydraulic circuit of an oil supply device in a low oil pressure control mode and in a high oil pressure control mode, respectively, according to a first embodiment of the present invention.

FIGS. 1(*a*) and 1(*b*) are schematic views of a hydraulic circuit of an oil supply device under low oil pressure control where oil pressure is relatively low and under high oil pressure control where oil pressure is relatively high, respectively, according to the first embodiment of the present invention.

The oil supply device is adapted to supply lubrication oil to various parts of an internal combustion engine (not shown) and includes a pump 1, an oil passage 2 through which the oil discharged from the pump 1 flows, an oil filter 3 arranged in the oil passage 2, an oil cooler 4 arranged in the oil passage 2, a bypass passage 5 connected to the oil passage 2 and bypassing the oil cooler 4, a bypass valve 6 arranged in the bypass passage 5 and an oil jet 7 arranged to cool a piston (not shown) of the internal combustion engine with the oil discharged from the pump 1. In FIG. 1, reference numeral 8 designates a main gallery of an engine cylinder block (not shown) that is located downstream of the bypass passage 5 and the oil cooler 4. The oil is supplied to the lubrication parts of the internal combustion engine through the main gallery.

The pump 1 is an electronically-controlled variable displacement vane pump of known type, which is capable of varying its oil discharge pressure, and is driven by a crankshaft (not shown) of the internal combustion engine. This pump 1 has a cam ring 11, a spring 12 that biases the cam ring 11, a rotor 13 arranged in the cam ring 11, a displacement adjustment valve 14 that adjusts the amount of displacement of the cam ring 11 relative to the rotor 13 and thereby varies the oil discharge amount of the pump, a solenoid valve 15 that adjusts the discharge pressure of the pump 1, a first pressure introduction room 16 to which a pressure of the oil downstream of the oil filter 3 is introduced through the displacement adjustment valve 14 and a second pressure introduction room 17 to which the pressure of the oil downstream of the oil filter 3 is introduced. The discharge pressure of the pump becomes relatively high as the discharge amount of the pump increases with increase in the amount of displacement of the cam ring 11.

To the displacement adjustment valve 14, the pressure of the oil downstream of the oil filter 3 is introduced. The displacement adjustment valve 14 is configured to, when the introduced oil pressure is higher than or equal to a predetermined pressure level, drain the introduced oil to an oil pan 18. The pressure of the oil introduced into the first pressure introduction room 16 acts in a direction that assists the biasing force of the spring 12 relative to the cam ring 11. On the other hand, the pressure of the oil introduced into the second pressure introduction room 17 acts in a direction that opposes the biasing force of the spring 12 relative to the cam ring 11. A drain passage 19 of the first pressure introduction room 16 is switched by the solenoid valve 15 into a full open state or a full close state.

The opening/closing operation of the solenoid valve 15 is controlled by an ECM 21 as a vehicle-mounted controller. In the first embodiment, the amount of displacement of the cam ring 11 can be made relatively small when the drain passage 19 is switched into the full open state by the solenoid valve 15. When the drain passage 19 is switched into the full close state by the solenoid valve 15, the amount of displacement of the cam ring 11 increases up to its maximum limit with increase in engine rotation speed. In other words, the discharge pressure of the pump 1 can be limited to a relatively low pressure level when the drain passage 19 is switched into the full open state by the solenoid valve 15 in the first embodiment.

Figure 2:
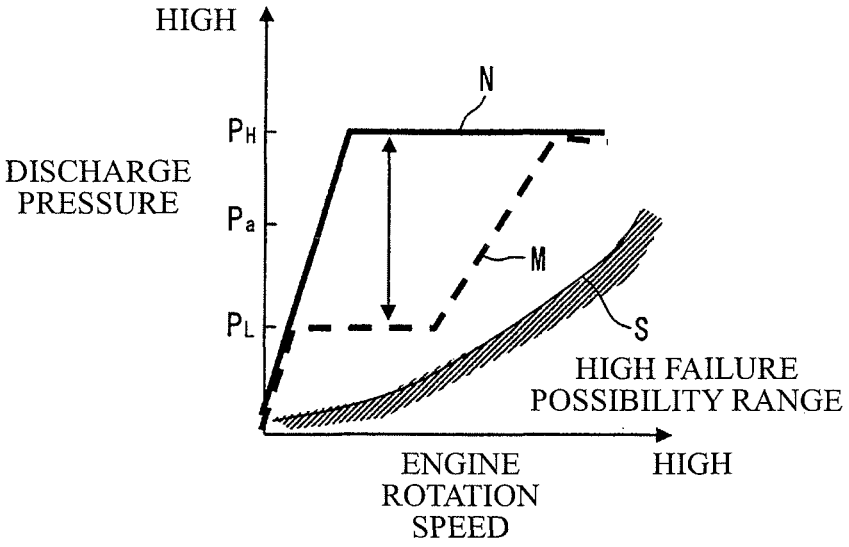
FIG. 2 is a schematic diagram showing pump oil pressure characteristics of the oil supply device according to the first embodiment of the present invention.

Consequently, the pump 1 shows a predetermined low oil pressure characteristic M in the full open state of the drain passage 19 and a predetermined high oil pressure characteristic N in the full close state of the drain passage 19 as shown in FIG. 2.

The low oil pressure characteristic M is set such that the discharge pressure of the pump 1 is relatively low during low-speed engine operation. More specifically, the discharge pressure of the pump 1 is set to a predetermined low pressure level $P_L$, regardless of engine rotation speed, in a specific low-speed engine operation range.

The high oil pressure characteristic N is set such that the discharge pressure of the pump 1 increases with increase in engine rotation speed but does not exceed a predetermined maximum pressure level $P_H$. More specifically, the discharge pressure of the pump 1 increases in proportion to engine rotation speed until the discharge pressure of the pump 1 reaches the maximum pressure level $P_H$. After the discharge pressure of the pump 1 reaches the maximum pressure level $P_H$, the discharge pressure of the pump 1 is maintained at the maximum pressure level $P_H$ regardless of increase in engine rotation speed. The discharge pressure of the pump 1 is thus kept relatively high at the maximum pressure level $P_H$ from a relatively low-speed engine operation range.

In FIG. 2, the range below a characteristic line S corresponds to where there is a high possibility of failure e.g. seizing at the engine sliding parts such as bearing due to poor lubrication. Both of the low oil pressure characteristic M and the high oil pressure characteristic N are set so as not to pass through this high failure possibility range.

It is herein noted that, even by the low oil pressure characteristic M, the discharge pressure reaches the maximum pressure level $P_H$ in a high-speed engine operation range. The reason for this is because the oil pressure increases as the discharge amount of the pump 1 becomes larger than the amount of leak from the drain passage 19 by the opening of the solenoid valve 15.

The open/close control of the drain passage 19 by the solenoid 15 is not limited to be performed in two stages: full open and full close. It is alternatively feasible to adjust the opening degree of the drain passage 19 to a desired level by duty control of the solenoid valve 19.

The ECU 21 has installed therein a microcomputer to perform various processing operations based on signals from sensors. Herein, the sensors includes an oil temperature sensor 22 for detecting a temperature of the oil downstream of the oil cooler 4, an oil pressure sensor 23 for detecting a pressure (hydraulic pressure) of the oil downstream of the oil cooler 4, a crank angle sensor 24 for detecting a crank angle and rotation speed of the internal combustion engine and a coolant temperature sensor 25 for detecting a temperature of coolant of the internal combustion engine.

The bypass valve 6 opens and closes the bypass passage 5 according to a pressure of the oil. When the pressure of the oil in the bypass passage 5 is lower than a predetermined valve opening pressure level Pa, the bypass valve 6 is switched into an open state as shown in FIG. 1(*a*) so that the oil bypasses the oil cooler 4. When the pressure of the oil in the bypass passage 5 is higher than or equal to the predetermined valve opening pressure level Pa, the bypass valve 6 is switched into a close state as shown in FIG. 1(*b*) so that the oil flows through the oil cooler 4.

Figure 3:
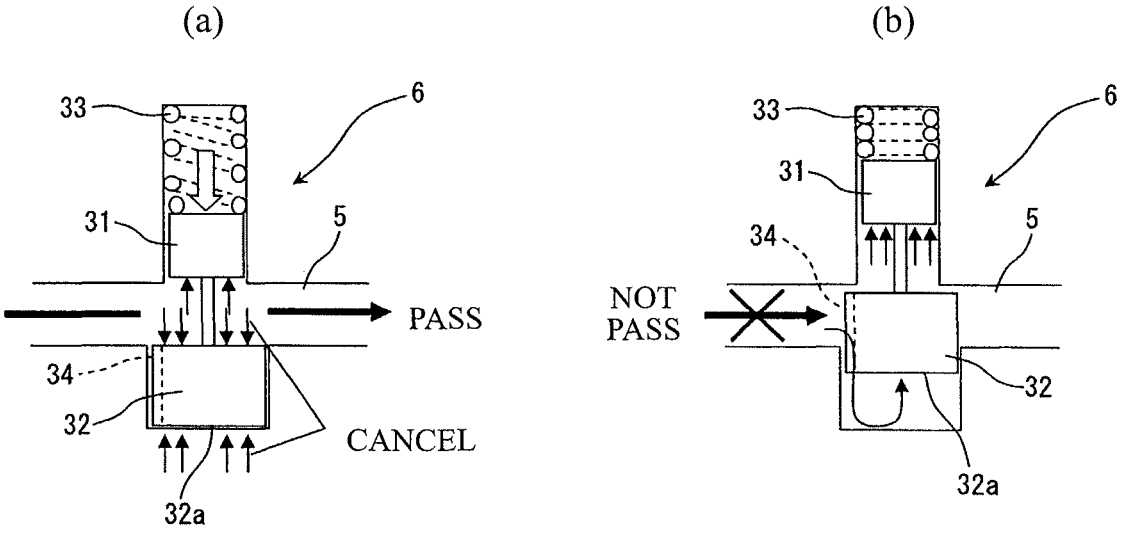
FIGS. 3(*a*) and 3(*b*) are schematic views of a bypass valve of the oil supply device in a valve open state and in a valve close state, respectively, according to the first embodiment of the present invention.

FIG. 3 is a schematic view showing one example of the bypass valve 6. The bypass valve 6 has a valve body 31 provided with a valve element 32 to open and close the bypass passage 5 and a coil spring 33 arranged to bias the valve body 31 in a valve opening direction all the time. In the first embodiment, a slit 34 is formed in the valve element 32 so as to introduce the pressure of the oil in the bypass passage 5 to a back side 32*a* of the valve element 32.

When the pressure of the oil in the bypass passage 5 is lower than the valve opening pressure level Pa, the biasing force of the coil spring 33 exerted on the valve body 31 is larger than the hydraulic force applied to the valve body 31 by the pressure of the oil in the bypass passage 5 so that the bypass passage 5 allows flow of the oil therethrough without being closed by the valve element 32 as shown in FIG. 3(*a*). When the pressure of the oil in the bypass passage 5 is higher than or equal to the valve opening pressure level Pa, the biasing force of the coil spring 33 exerted on the valve body 31 is smaller than the hydraulic force applied to the valve body 31 by the pressure of the oil in the bypass passage 5 so that the bypass passage 5 is closed by the valve element 32 and does not allow the oil to flow therethrough as shown in FIG. 3(*b*). As shown in FIG. 2, the valve opening pressure level Pa is set higher than the low pressure level $P_L$ of the low oil pressure characteristic M and lower than the maximum pressure level $P_H$ in the first embodiment.

The oil jet 7 is configured to, when the pressure of the oil is higher than or equal to a predetermined pressure level, inject the oil to the engine piston and thereby cool the engine piston. In the first embodiment, the oil jet 7 is controlled not to inject the oil when the pressure of the oil is lower than the valve opening pressure level Pa of the bypass valve 6 but to inject the oil when the pressure of the oil is higher than or equal to the valve opening pressure level Pa of the bypass valve 6.

As the oil jet 7 is intended for cooling of the engine piston, the situation where the injection of the oil from the oil jet 7 is desired corresponds to the situation where the flow of the oil through the oil cooler 4 is desired. It is thus possible to appropriately control the opening and closing of the bypass valve 6 and the injection of the oil from the oil jet 7 according to the pressure of the oil by setting the pressure of the oil at which the oil injection operation of the oil jet 7 is allowed to the same level as the valve opening pressure level Pa of the bypass valve 6.

The discharge pressure of the pump 1 is adjusted according to the operating conditions of the internal combustion engine, such as oil temperature, coolant temperature, engine rotation speed, engine torque (load) etc. As a result, the opening and closing of the bypass valve 6 and the injection of the oil from the oil jet 7 are controlled according to the discharge pressure of the pump 1.

In the first embodiment, there are provided four low/high oil pressure switching control maps as shown in FIGS. 4 to 7. The oil supply device properly selects and uses one of these four oil pressure switching control maps based on the oil temperature and the coolant temperature and switches between the low oil pressure control and the high oil pressure control according to the engine rotation speed and torque (load) with reference to the oil pressure switching control map.

Figure 4:
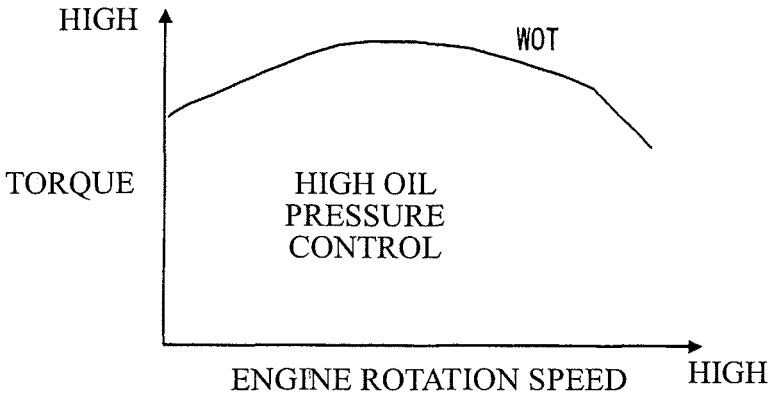
FIG. 4 is a control map for switching between the low oil pressure control mode and the high oil pressure control mode of the oil supply device in a very low temperature state according to the first embodiment of the present invention.

In a very low temperature state where the temperature of the coolant is lower than −15° C., the low/high oil pressure switching control map of FIG. 4 (referred to as "control map A") is used. As the lubrication by the oil is unstable in the very low temperature state, the high oil pressure control is performed throughout the entire engine operation range so as to sufficiently supply the oil to the engine sliding parts.

Figure 5:
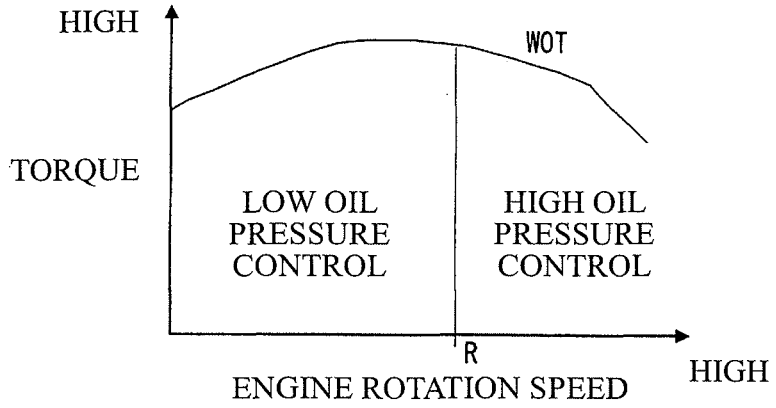
FIG. 5 is a control map for switching between the low oil pressure control mode and the high oil pressure control mode of the oil supply device in a low coolant temperature state according to the first embodiment of the present invention.

In a low-temperature engine operation state where the temperature of the coolant is in the range of −15° C. to 60° C., the low/high oil pressure switching control map of FIG. 5 (referred to as "control map B") is used. In this control map B, the high oil pressure control is performed when the engine rotation speed is higher than or equal to a predetermined speed level R (e.g. 4500 rpm); and the low oil pressure control is performed when the engine rotation speed is lower than the predetermined speed level R. Namely, the low oil pressure control is performed in a low-speed engine operation range. During the low oil pressure control, the injection of the oil from the oil jet 7 is stopped to accelerate warm-up of the piston crown surface. It is thus possible to promote fuel evaporation and reduce PM emissions for improve in exhaust performance. Further, the high oil pressure control is performed in a high-speed engine operation range so as to secure sufficient oil-film pressure at the engine sliding parts such as bearing.

Figure 6:
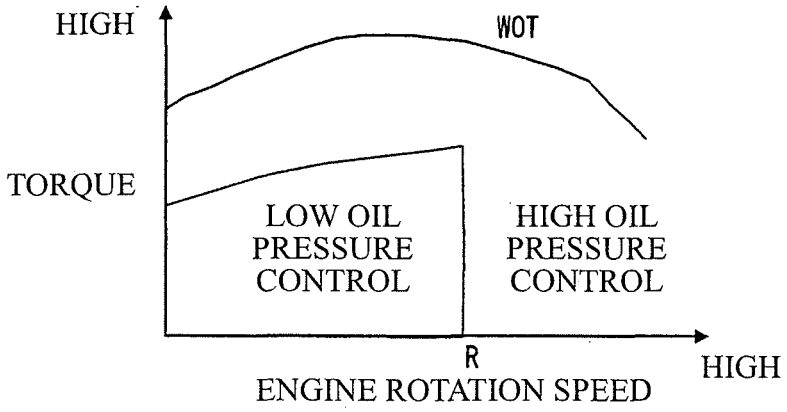
FIG. 6 is a control map for switching between the low oil pressure control mode and the high oil pressure control mode of the oil supply device in a high coolant temperature state according to the first embodiment of the present invention.

In an engine warm-up state where the temperature of the coolant is higher than 60° C. and the temperature of the oil is lower than or equal to 120° C., the low/high oil pressure switching control map of FIG. 6 (referred to as "control map C") is used. In this control map C, the high oil pressure control is performed when the internal combustion engine is higher in rotation speed than or equal to the predetermined speed level R and when the internal combustion engine is high in load and is lower in rotation speed than the predetermined speed level R; and the low oil pressure control is preformed when the internal combustion engine is low in load and is lower in rotation speed than the predetermined speed level R. Namely, the high oil pressure control is performed in a low-speed high-torque engine operation range for prevention of knocking. During the high oil pressure control, the oil is injected from the oil jet 7. The low oil pressure control is performed in a low-speed low-load engine operation range so as to relatively reduce a load of the pump 1 and prevent deterioration in fuel efficiency.

Figure 7:
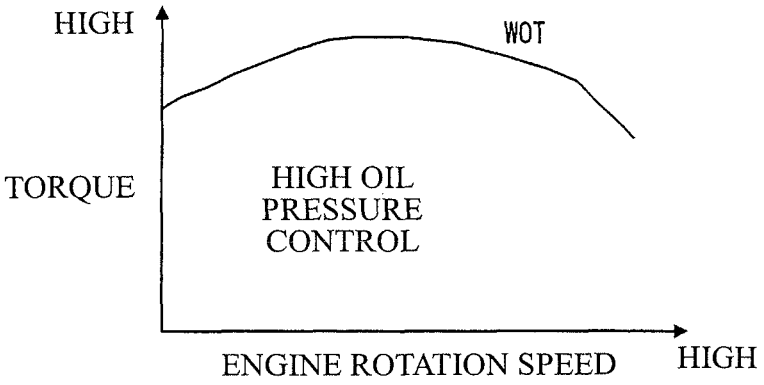
FIG. 7 is a control map for switching between the low oil pressure control mode and the high oil pressure control mode of the oil supply device in a high oil temperature state according to the first embodiment of the present invention.

In a high-temperature engine operation state where the temperature of the oil is higher than 120° C., the low/high oil pressure switching control map of FIG. 7 (control map D) is used. As the lubrication by the oil is unstable in the high temperature state, the high oil pressure control is performed throughout the entire operation range so as to sufficiently supply the oil to the engine sliding parts.

Figure 8:
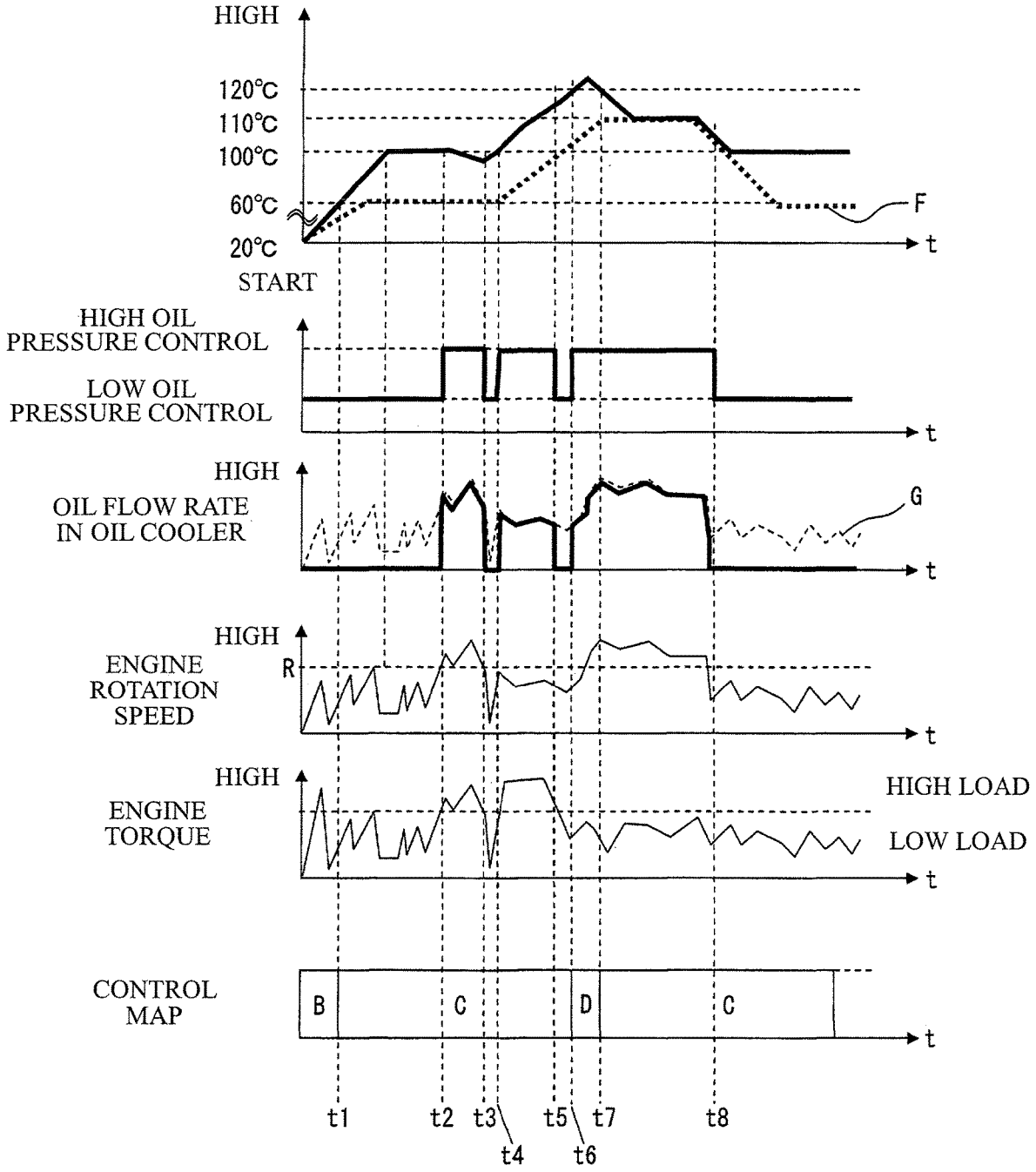
FIG. 8 is a time chart for control process of the oil supply device according to the first embodiment of the present invention.

FIG. 8 shows one example of time chart for control process of the oil supply device in the first embodiment.

After cold start of the internal combustion engine, the discharge pressure of the pump 1 is switched and controlled according to the control map B until time t1 when the temperature of the coolant reaches 60° C. After time t1 when the temperature of the coolant reaches 60° C., the discharge pressure of the pump 1 is switched and controlled according to the control map C. In the present example, the low oil pressure control is over a time period from the cold engine start to time t2 when the engine rotation speed becomes higher than or equal to the predetermined speed level R during the use of the control map C because of the reason that the internal combustion engine is low in load and is lower in rotation speed than the predetermined speed level R for this time period. The high oil pressure control is performed over a time period from time t2 to time t3 when the engine rotation speed remains higher than the predetermined speed level R. The low oil pressure control is performed over a time period from time t3 to time t4 because of the reason that the internal combustion engine is low in load and is lower in rotation speed than the predetermined speed level R for this time period. Over a time period from time t4 to time t5, the high oil pressure control is performed because the internal combustion engine is lower in rotation speed than the predetermined speed level R but becomes high in load. Over a time period from time t5 to time t6, the low oil pressure control is performed because the internal combustion engine becomes low in load and lower in rotation speed than the predetermined speed level R. Then, the discharge pressure of the pump 1 is switched and controlled according to the control map D over a time period from time t6 to t7 because of the reason that the temperature of the oil becomes higher than 120° C. That is, the high oil pressure control is performed over the time period from time t6 to time t7. After time t7, the discharge pressure of the pump 1 is again switched and controlled according to the control map C because the temperature of the oil becomes lower than or equal to 120° C. The high oil pressure control is performed over a time period from time t7 to time t8 because of the reason that the internal combustion engine is lower in rotation speed than the predetermined speed level R for this time period. After time t8, the low oil pressure control is performed because the internal combustion engine is low in load and lower in rotation speed than the predetermined speed level R.

In FIG. 8, a characteristic line F and a characteristic line G respectively indicate changes of the oil temperature and oil flow rate in the case where the oil flows through the oil cooler 4 all the time in the above configuration of FIG. 1.

As described above, the oil supply device is able to maintain the temperature of the oil at a relatively high temperature level and thereby maintain the viscosity of the oil at a relatively low viscosity level in the first embodiment as compared to the case where the oil flows through the oil cooler 4 all the time (as indicated by the broken characteristic line F in FIG. 8). It is accordingly possible to relatively reduce friction and improve fuel efficiency in the internal combustion engine.

Further, the oil supply device is adapted to control the flow of the oil through the oil cooler 4 according to the engine operating conditions by adjusting the discharge pressure of the pump 1. It is thus possible to relatively reduce the load of the pump 1. In other words, the load of the pump 1 can be effectively reduced in e.g. a low-load engine operation range, which occupies a high proportion of actual engine operation, as the oil is allowed to flow through the oil cooler 4 as required such that there is less influence of pressure loss caused by the flow of the oil through the oil cooler 4.

The present invention is not limited to the above exemplary embodiment. For example, it is feasible to adjust the discharge pressure of the pump 1 in such a manner that the oil flows into the oil cooler 4 when the temperature of the oil is higher than or equal to a predetermined temperature level as shown in FIG. 9.

Figure 9:
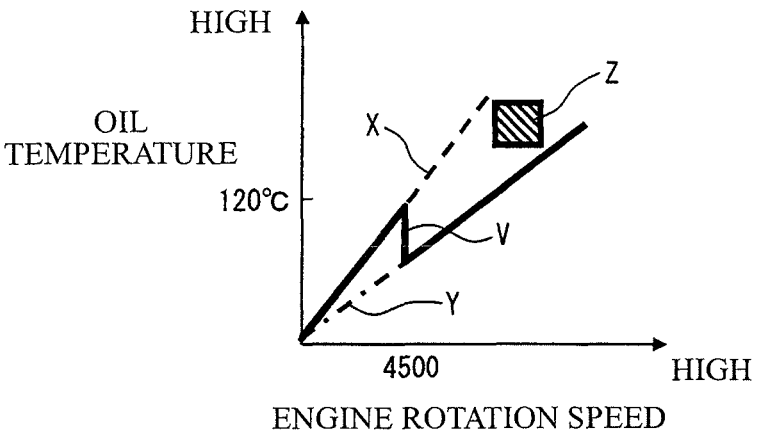
FIG. 9 is a schematic diagram showing pump oil pressure characteristics of an oil supply device according to a second embodiment of the present invention.

In FIG. 9, a broken characteristic line X and a dot dashed characteristic line Y shows the relationship of the oil temperature and the engine rotation speed in the case where the oil does not flow through the oil cooler 4 and in the case where the oil flows through the oil cooler 4, respectively. Although both of the characteristic lines X and Y are set such that the oil temperature increases in proportion to the engine rotation speed, the characteristic line Y is lower in oil temperature than the characteristic line X.

As the friction increases with increase in the viscosity of the oil, there is no need to cool the oil in an operation range where the oil temperature and the engine rotation speed are low (e.g. where the oil temperature is lower than or equal to 120° C. and the engine rotation speed is lower than or equal to 4500 rpm). On the other hand, there is a high possibility of failure due to unstable lubrication by the oil in a specific operation range Z where both of the oil temperature and the engine rotation speed are high.

It is thus possible to relatively reduce the load of the pump 1 and prevent deterioration in fuel efficiency in a low-load engine operation range, which occupies a high proportion of actual engine operation, by stopping the flow of the oil through the oil cooler 4 until the oil temperature reaches than a predetermined temperature range (e.g. 120° C.) and allowing the oil to flow through the oil cooler 4 when the oil temperature becomes higher than or equal to the predetermined temperature range (e.g. 120° C.) as indicated by a solid characteristic line V.

Figure 10:
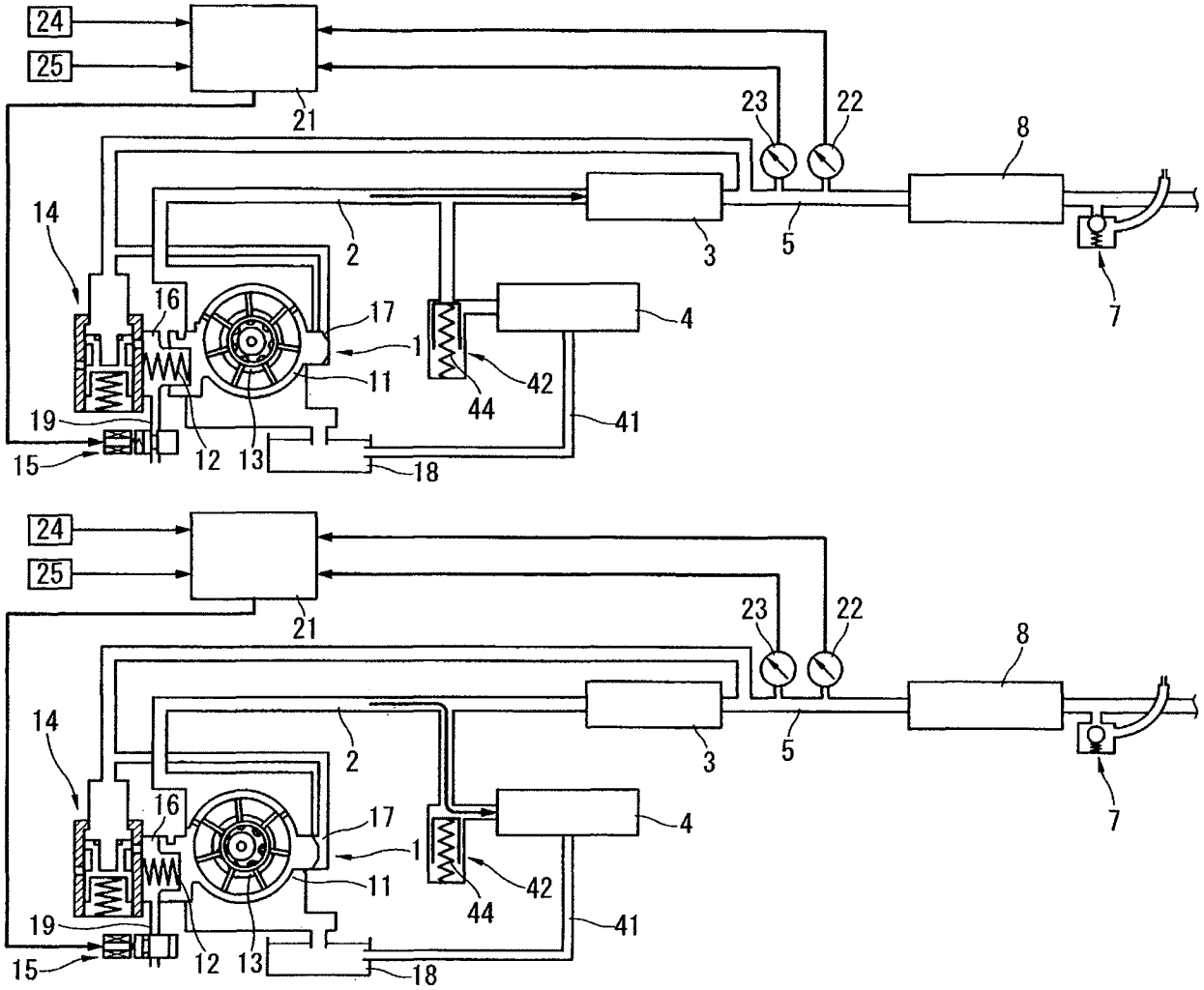
FIGS. 10(*a*) and 10(*b*) are schematic views of a hydraulic circuit of the oil supply device in a low oil pressure control mode and in a high oil pressure control mode, respectively, according to the second embodiment of the present invention.

Further, it is feasible to embody the present invention as an oil supply device as shown in FIG. 10.

FIGS. 10(*a*) and 10(*b*) are schematic views of a hydraulic circuit of the oil supply device under low oil pressure control where oil pressure is relatively low and under high oil pressure control where oil pressure is relatively high, respectively, according to the second embodiment of the present invention. It is herein noted that, in the second embodiment, the same parts and portions as those in the first embodiment are designated by the same reference numerals and detailed explanation thereof shall be omitted herefrom.

The oil supply device of the second embodiment is substantially similar in structure to the oil supply device of the first embodiment. In the second embodiment, the oil cooler 4 is arranged in a drain passage 41. The drain passage 41 is connected to the oil passage 2 at an upstream side of the oil filter 3 so as to return the oil from the upstream side of the oil filter 3 to the oil pan 18. Further, a bypass valve 42 is arranged in the drain passage 41 so as to open and close the drain passage 41 according to the pressure of the oil upstream of the oil cooler 4 in the second embodiment.

The bypass valve 42 has a valve body 43 to open and close the drain passage 41 and a coil spring 44 to bias the valve body 43 in a valve closing direction all the time. When the pressure of the oil is lower than a predetermined valve opening pressure level Pa, the bypass valve 42 is switched into a close state as shown in FIG. 10(*a*). When the pressure of the oil is higher than or equal to the predetermined valve opening pressure level Pa, the bypass valve 42 is switched into an open state as shown in FIG. 10(*b*).

The bypass valve 42 is closed and does not allow the oil to flow through the oil cooler 4 when the pressure of the oil is lower than the predetermined valve opening pressure level Pa. When the pressure of the oil is higher than or equal to the predetermined valve opening pressure level Pa, the bypass passage 42 is opened and allows the flow of the oil through the oil cooler 4.

It is accordingly possible that the oil supply device of the second embodiment can obtain the same effects as those of the first embodiment.

The invention claimed is:

1. An oil supply device for an internal combustion engine, comprising:

a variable displacement pump that varies a discharge pressure at which oil is discharged;

an oil passage through which the oil discharged from the variable displacement pump flows;

an oil cooler arranged in the oil passage;

a bypass passage connected to the oil passage so as to bypass the oil cooler and supply the oil to various parts of the internal combustion engine; and a controller that performs pressure control to adjust the discharge pressure of the variable displacement pump according to operating conditions of the internal combustion engine including a temperature of the oil, a rotation speed and load of the internal combustion engine and a temperature of coolant, wherein the oil supply device further comprises a bypass valve arranged in the bypass passage, wherein the bypass valve is operated to:

allow the oil to flow through the bypass passage when a pressure of the oil fed in the bypass passage is lower than a predetermined pressure level; and restrict flow of the oil through the bypass valve and thereby allow the oil to flow to the oil cooler when the pressure of the oil fed in the bypass passage is higher than or equal to the predetermined pressure level, and wherein the controller is configured to:

set an oil temperature level according to the rotation speed of the internal combustion engine; and adjust the discharge pressure of the variable displacement pump by said pressure control such that, when the temperature of the oil is higher than the set oil temperature level, the pressure of the oil discharged from the variable displacement pump and fed in the bypass valve becomes higher than or equal to the predetermined pressure level, whereby the bypass valve allows the flow of the oil to the oil cooler.

2. The oil supply device for the internal combustion engine according to claim 1, further comprising a piston cooling oil jet supplied with the oil from the variable displacement pump and arranged to inject the oil to a piston of the internal combustion engine when the pressure of the oil supplied to the piston cooling oil jet is higher than or equal to the predetermined pressure level and to stop injection of the oil when the pressure of the oil supplied to the piston cooling oil jet is lower than the predetermined pressure level.

3. The oil supply device for the internal combustion engine according to claim 1, wherein the oil cooler is arranged in a part of the oil passage directed to the various parts of the internal combustion engine.

4. The oil supply device for the internal combustion engine according to claim 1, wherein the oil cooler is arranged in a part of the oil passage directed to an oil pan of the internal combustion engine.

5. The oil supply device for the internal combustion engine according to claim 1, wherein the controller stores therein oil pressure control maps and performs the pressure control by switching between the oil pressure control maps.

6. The oil supply device for the internal combustion engine according to claim 1, wherein the controller is configured to control the variable displacement pump in such a manner that the pressure of the oil discharged from the variable displacement pump and fed in the bypass valve becomes lower than the predetermined pressure level when the temperature of the oil is lower than or equal to a second oil temperature level, the temperature of the coolant is higher than a predetermined coolant temperature level, and the internal combustion engine is in a low-load low-speed operation state.

* * * * *